US012256834B2

(12) United States Patent
Havard et al.

(10) Patent No.: US 12,256,834 B2
(45) Date of Patent: Mar. 25, 2025

(54) GAME TABLE INCLUDING AT LEAST ONE STABILIZER LEG

(71) Applicant: CORNILLEAU SAS, Bonneuil les Eaux (FR)

(72) Inventors: Nicolas Havard, Bonneuil les Eaux (FR); Romain Radreaux, Lihons (FR); Fabrice Clement, Paillart (FR)

(73) Assignee: CORNILLEAU SAS, Bonneuil les Eaux (FR)

( * ) Notice: Subject to any disclaimer, the term of this patent is extended or adjusted under 35 U.S.C. 154(b) by 671 days.

(21) Appl. No.: 17/243,323

(22) Filed: Apr. 28, 2021

(65) Prior Publication Data

US 2021/0337963 A1 Nov. 4, 2021

(30) Foreign Application Priority Data

Apr. 29, 2020 (FR) ..... 2004252

(51) Int. Cl.

| | |
|---|---|
| ***A47B 3/091*** | (2006.01) |
| ***A47B 91/02*** | (2006.01) |
| ***A47B 91/16*** | (2006.01) |
| ***A63B 67/04*** | (2006.01) |
| ***A63D 15/00*** | (2006.01) |
| ***A63F 7/36*** | (2006.01) |
| *A47B 25/00* | (2006.01) |

(52) U.S. Cl.

CPC ..... *A47B 3/0915* (2013.01); *A47B 91/028* (2013.01); *A47B 91/16* (2013.01); *A63B 67/04* (2013.01); *A63D 15/00* (2013.01); *A63F 7/36* (2013.01); *A47B 25/003* (2013.01); *A63B 2210/50* (2013.01); *A63F 2007/3692* (2013.01)

(58) Field of Classification Search

CPC ..... A47B 91/02; A47B 91/022; A47B 91/028; A47B 91/16; A47B 3/0915; A47B 25/003; A47B 25/00; A63B 67/04; A63B 2210/50; A63D 15/00; A63F 7/36; A63F 2007/3692

See application file for complete search history.

(56) References Cited

U.S. PATENT DOCUMENTS

| | | | | |
|---|---|---|---|---|
| 2,499,277 A | | 2/1950 | Nalle | |
| 3,104,493 A | * | 9/1963 | Nalle | A47B 91/028 248/188.4 |
| 4,522,395 A | * | 6/1985 | Arndt | A63B 67/04 473/475 |
| 10,524,564 B1 | * | 1/2020 | Wu | A47B 9/20 |
| 2012/0073480 A1 | * | 3/2012 | Korb | A47B 91/02 108/147.18 |
| 2018/0313095 A1 | * | 11/2018 | Heschel | E04H 12/2261 |

FOREIGN PATENT DOCUMENTS

| | | | | |
|---|---|---|---|---|
| CN | 108784045 A | * | 11/2018 | |
| DE | 19846647 A1 | * | 9/1999 | A47B 91/024 |
| DE | 699 04 774 T2 | | 10/2003 | |

(Continued)

*Primary Examiner* — Raleigh W Chiu

(74) *Attorney, Agent, or Firm* — MUNCY, GEISSLER, OLDS & LOWE, P.C.

(57) ABSTRACT

A game table including a tabletop and at least one stabilizer leg for stabilizing said tabletop, the leg having a body, a rod mounted to move in translation relative to the body between a retracted position and an extended position, and a shoe carried by a distal end of the rod.

9 Claims, 2 Drawing Sheets

(56) References Cited

FOREIGN PATENT DOCUMENTS

| | | | | | |
|---|---|---|---|---|---|
| DE | 10312160 | A1 | * | 9/2004 | ..... A47B 13/021 |
| DE | 202016104650 | U1 | * | 10/2016 | ..... A47B 91/02 |
| DE | 102017010611 | A1 | * | 5/2019 | ..... A47B 17/02 |
| EP | 0722681 | A2 | * | 7/1996 | |
| EP | 1719923 | A1 | * | 11/2006 | ..... A47B 91/02 |
| EP | 3903637 | A1 | * | 11/2021 | ..... A47B 3/0915 |
| FR | 2754439 | A1 | * | 4/1998 | ..... A47B 91/02 |
| GB | 568 277 | A | | 3/1945 | |
| GB | 2408449 | A | * | 6/2005 | ..... A47B 91/024 |
| GB | 2528962 | A | * | 2/2016 | ..... A47B 91/022 |
| KR | 200420040 | Y1 | * | 2/2006 | |
| KR | 20160062363 | A | * | 6/2016 | |
| KR | 20230049419 | A | * | 4/2023 | |
| WO | WO-8801145 | A | * | 2/1988 | ..... A47B 91/028 |

* cited by examiner

GAME TABLE INCLUDING AT LEAST ONE STABILIZER LEG

The invention relates to the field of game tables, and preferably, but not exclusively, to tables for playing table tennis, pool, or foosball.

BACKGROUND OF THE INVENTION

Game tables, such as table tennis tables, are known that are foldable in order to make them easier to store and/or to move.

For example, patent document EP 3 320 802 discloses a game table presenting:

- a tabletop comprising a first tabletop portion presenting a first plane surface and a second tabletop portion presenting a second plane surface;
- stabilizer legs;
- wheeled legs, each fitted with at least one wheel enabling the table to roll on a floor; and
- a link mechanism connecting the tabletop firstly to each stabilizer leg and secondly to each of the wheeled legs.

In a playing configuration, such a table normally stands on the floor solely via its stabilizer legs, with the wheeled legs being reserved solely for storing and stowing the table.

When the floor is not completely plane, the table can end up sloping, which is not desirable in the playing configuration. Consequently, it can be desirable to modify the positions of the stabilizer legs relative to one another and to the tabletop in order to make said tabletop more horizontal.

For this purpose, it is known to provide the bottom ends of the stabilizer legs with shoes: each shoe is screwed into the associated leg so that screwing the shoe in or out serves to modify the length of said stabilizer leg. The horizontal position of the tabletop can thus be adjusted relatively finely by acting on the length of each of the legs.

Unfortunately, such a system makes it necessary to lift the table in order to give access to the shoe in question so as to be able to screw it in or out. This is relatively tedious and usually requires action to be taken by two people: one to hold the table and the other to turn the shoe.

OBJECT OF THE INVENTION

An object of the invention is to propose a game table that makes it easier to put its tabletop in a horizontal position even if the floor on which the table is standing is not plane.

SUMMARY OF THE INVENTION

In order to achieve this object, the invention provides a game table comprising a tabletop and at least one stabilizer leg for stabilizing said tabletop.

According to the invention, the leg comprises a body, a rod mounted to move in translation relative to the body between a retracted position and an extended position, and a shoe carried by a distal end of the rod.

Thus, it is possible for a user merely to slide the rod relative to the body in order to raise or lower the shoe relative to the tabletop: there is thus no longer any need to act on the shoe itself, thereby making the stabilizer leg easier to handle.

It is thus easier to put the tabletop in a horizontal position even if the floor on which the table is standing is not plane.

Throughout the present application, terms such as "bottom", "top", . . . should be understood relative to the in-service position of the game table when it is standing on a floor via its stabilizer leg.

Optionally, the rod is arranged at least in part inside the body.

Optionally, the rod has an outside thread.

Optionally, the table includes a nut mounted to rotate relative to the body, the rod having a thread suitable for co-operating with tapping of said nut, such that turning the nut in one direction or the other causes the rod to move in translation between said two positions.

Optionally, the nut is rotatably mounted at the distal end of the body.

Optionally, the table is shaped in such a manner that the shoe is substantially level with the nut when the rod is in the retracted position.

Optionally, the shoe is provided with antirotation means for preventing the rod from rotating.

Optionally, the antirotation means comprise a male member and a female member acting together to guide the sliding of the rod in the body.

Optionally, the male member and the female member together limit movement of the rod relative to the body.

Optionally, the male member and the female member together form an abutment defining the extended position of the rod and/or an abutment defining the retracted position of the rod.

Optionally, the male member and the female member form a peg and slot arrangement.

Optionally, the rod includes marker means for identifying its position relative to the body and/or the nut.

Optionally, the shoe is connected to the rod by a ball joint.

Optionally, the table is a table tennis table or foosball or pool.

Other characteristics and advantages of the invention appear on reading the following description of a particular, nonlimiting embodiment of the invention.

BRIEF DESCRIPTION OF THE DRAWINGS

The invention can be better understood in the light of the following description given with reference to the accompanying figures, in which.

DETAILED DESCRIPTION OF THE INVENTION

Figure 1:
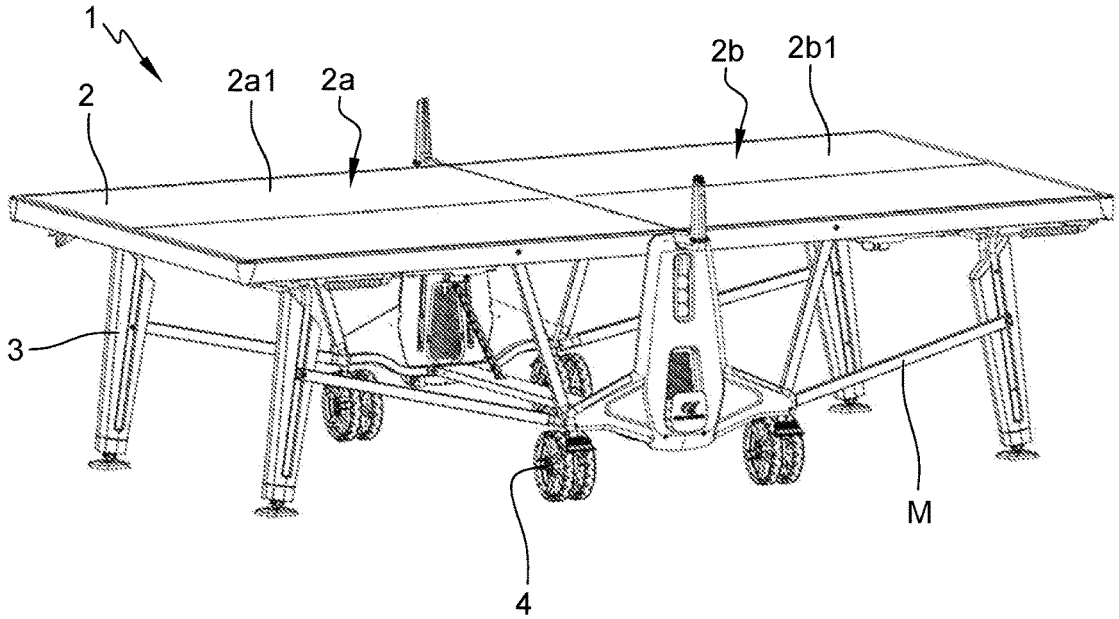
FIG. 1 is a diagrammatic perspective view of a table in a particular embodiment of the invention, the table being in its playing configuration on a floor.

With reference to FIG. 1, the game table 1 in a particular embodiment of the invention is specifically a table for playing table tennis.

The game table 1 includes a tabletop 2 comprising a first tabletop portion 2*a* presenting a first plane surface 2*a*1 and a second tabletop portion 2*b* presenting a second plane surface 2*b*1.

The game table 1 also includes wheeled legs 4 (only one of which is referenced in the figures) each of which is fitted with at least one wheel R for enabling the table to roll of a floor S.

In addition, the game table 1 includes at least one stabilizer leg, and preferably a plurality of stabilizer legs 3 (only one of which is referenced in the drawings).

In the present example, the game table 1 has four stabilizer legs 3 each associated with a respective one of the corners of the game table 1, together with two middle wheeled legs 4: one of which is associated with the right side of the game table 1, and the other of which is associated with the left side of the game table 1.

A link mechanism M of the game table 1 enables the tabletop portions 2*a* and 2*b* to be connected both to at least one stabilizer leg 3 and also to each of the wheeled legs 4.

Figure 2:
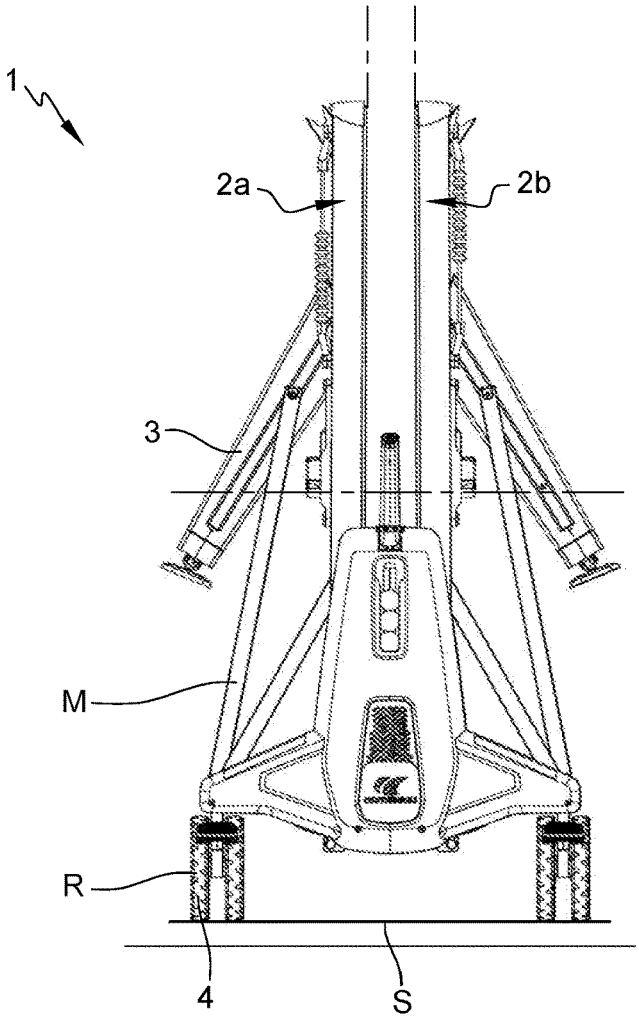
FIG. 2 is a diagrammatic side view of the table shown in FIG. 1, with the table in its storage configuration.
Figure 3:
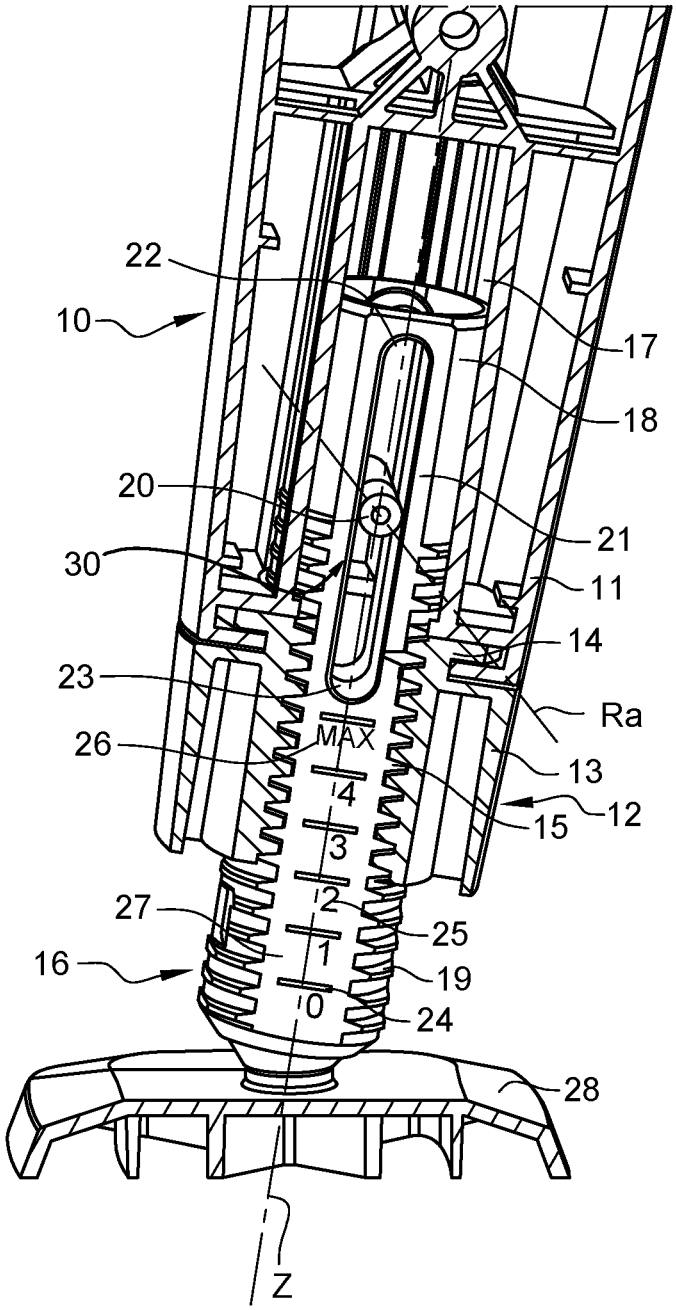
FIG. 3 is a perspective view of a stabilizer leg of the table shown in FIG. 1 when a rod of said leg is between its retracted position and its extended position.

The game table 1 can adopt selectively a storage configuration as shown in FIG. 2 or a game configuration as shown in FIG. 1.

In this example, the stabilizer legs 3 are identical to one another, so the description below of one of the stabilizer legs 3 applies equally to the other stabilizer legs 3.

A stabilizer leg 3 comprises a body 10 having at least a distal end 11 (i.e. the end of the body 10 that is furthest from the tabletop 2) that is in the shape of a body of revolution about a first axis Z.

In this example, the distal end 11 of the body 10 has the outside shape of a truncated cone. The distal end 11 of the body 10 is also hollow.

The stabilizer leg 3 preferably includes a nut 12 extending the distal end of the body 10. The nut 12 is also in the shape of a body of revolution about the first axis Z, such that the nut 12 and the distal end 11 of the body 10 both lie coaxially along the same first axis Z.

The nut 12 presents an active portion 13 that is to be handled by a user, which active portion 13 is extended upwards by a connection portion 14 for connection to the body 10. In this example, the connection portion 14 is mounted in the distal end 11 of the body 10 so as to be rotatable about the first axis Z.

In this example, the active portion 13 is in the shape of a truncated cone. The active portion 13 and the distal end 11 of the body 10 are thus shaped so as to present substantially the same outside diameter at their junction. The junction between the active portion 13 and the distal end 11 of the body 10 therefore does not present any external setback or shoulder.

The nut 12 also presents a tapped hole 15 passing right through it: the tapped hole 15 thus passes both through the connection portion 14 and through the active portion 13. At the distal end 11 of the body 10, the tapped hole 15 also extends coaxially with the remainder of the nut 12, and thus about the first axis Z.

Furthermore, the stabilizer leg 3 includes a rod 16 that is likewise in the shape of a body of revolution about the first axis Z, such that the rod 16, the nut 12, and the distal end 11 of the body 10 are all coaxial about the first axis Z.

The rod 16 is preferably arranged, at least in part, inside the body 10.

Typically, the body 10 includes an internal bushing 17 extending along the first axis Z, with the proximal end 18 of the rod 16 being slidably received in said bushing 17.

The rod 16 thus slides along the first axis Z relative to the body 10 and inside said body 10, and in particular inside its bushing 17.

Over at least a portion of its outside surface, the rod 16 preferably presents a thread suitable for co-operating with the tapping of the tapped hole 15 in the nut 12.

Preferably at least the distal end 19 of the rod 16 has an outside thread. In the present example, the thread extends over 30% to 90% of the total length of the rod 16 (length considered along the first axis Z), and preferably over 40% to 80% of the height of the rod 16 (length considered along the first axis Z).

The stabilizer leg 3 also includes antirotation means 30 for preventing the rod 16 from rotating relative to the body 10.

Optionally, the antirotation means 30 comprise a peg-and-slot arrangement for guiding the rod 16 slidably in the body 10. By way of example, the peg 20 is associated with the body 10, and the slot 21 is associated with the rod 16.

In this example, the peg 20 is arranged inside the body 10 so as to extend in a radial direction Ra that is orthogonal to the first axis Z. Preferably, the peg 20 extends right through the body 10 and is thus fastened to said body 10 at both of its ends. Optionally, the peg 20 is made integrally with said body 10.

The slot 21 is formed in the rod 16 so as to pass right through the rod 16. The peg 20 thus naturally extends inside the slot 21 so that it also passes right through the rod 16 in the radial direction Ra.

The slot 21 is also shaped in such a manner as to present a section that is oblong (in a section plane normal to the radial direction Ra). The slot 21 is thus closed at each of its top and bottom ends (along the first axis Z).

Thus, in addition to preventing the rod 16 from rotating relative to the body 10, the slot 21 and the peg 20 limits movement in translation of the rod 16 relative to the body 10 along the first axis Z. Together, the slot 21 and the peg 20 thus form a first abutment when the peg 20 comes to bear against the top end 22 of the slot 21, thereby defining a retracted position of the rod 16, and a second abutment when the peg 20 comes to bear against the bottom end 22 of the slot 21, thereby defining an extended position of the rod 16.

Preferably, the rod 16 includes marker means for identifying the position of the rod 16 relative to the body 10 (position considered along the first axis Z). In this example, said means are arranged directly on the rod 16.

Thus, as the rod 16 slides out from the body 10, the marker means appear progressively.

The user can thus estimate easily the extent to which the rod 16 is extended from the body 10. Specifically, in the retracted position of the rod 16, the marker means are not visible: in contrast, they appear progressively as the rod 16 is extended from the body 10.

The marker means optionally extend along the rod 16 from its distal end substantially as far as the bottom end of the slot 21.

By way of example, the marker means comprise graduations and/or alphanumerical signs and/or symbols.

In the present example, the marker means include at least graduations 24 (only some of which are referenced in the figures). For example, each graduation 24 is in the form of a line, with the various lines being arranged at different positions along the rod 16. The lines are preferably spaced apart at regular intervals.

Optionally, the marker means also include at least one alphanumerical sign 25 (only some of which are referenced in the figures) associated with each graduation 24. By way of example, a number is associated with each graduation 24.

Preferably, the marker means also include an indication 26 concerning maximum extension of the rod 16 from the body 10. By way of example, the indication 26 may be a word such as "max" or "maximum" or "stop". Optionally, this indication 26 becomes visible to the user (i.e. when the portion of the rod 16 carrying said indication 26 moves out from the body 10) substantially at the same moment as when the peg 20 comes into abutment against the top end 22 of the slot 21.

In a particular embodiment, at least one zone of the outside surface of the rod 16 is plane, the marker means being marked in that zone.

This enables the marker means to be seen more clearly.

Preferably, at least two distinct zones of the outside surface of the rod 16 are plane. By way of example, these two zones may be arranged symmetrically about the first axis Z.

For example, the rod 16 is shaped so as to present two outside plane faces 27 (the two above-mentioned zones) and two rounded faces, each connecting together the two plane faces 27. In this example, the rod 16 is thus generally in the shape of a cylinder having two opposite flats.

It should be recalled that the slot 21 in this example passes right through the rod 16. It is then preferable for the rod 16 to be shaped in such a manner that the slot 21 extends between the two plane faces 27 so as to open out into each of said two plane faces 27.

Each plane face 27 thus lies in a plane that is normal to the radial direction Ra.

In this example, it should thus be understood that the thread on the rod 16 does not extend over its entire outside circumference, but rather over its two rounded faces only. Naturally, this does not impede rotation of the nut 12 relative to the rod 16 since the plane faces 27 do not project from the thread.

Furthermore, the stabilizer leg 3 includes a shoe 28 carried by the distal end 19 of the rod 16, the shoe 28 being the portion of the stabilizer leg 3 that is to rest on the floor S. In the present example, the shoe 28 extends the rod 16. By way of example, the shoe 28 is connected to the rod 16 via the bottom face of said rod 16.

The shoe 28 is preferably secured to the rod 16 by a ball joint.

The ability of the shoe 28 to pivot relative to the remainder of the stabilizer leg 3 serves in particular to facilitate stabilizing the game table 1 on the floor S and thus to make it easier to put the tabletop 2 in a horizontal position.

In service, if the rod 16 is in its retracted position, the peg 20 is in abutment against the bottom end 23 of the slot 21. The rod 16 is then entirely or almost entirely retracted into the body 10. The stabilizer leg 3 is shaped in such a manner that the shoe 28 is preferably level with the nut 12.

The user may desire to increase the length of the stabilizer leg 3. Under such circumstances, the user turns the nut 12 in a first direction of rotation.

As a result of cooperation between the tapping of the nut 10 and the thread of the rod 16, rotation of the nut 12 relative to the body 10 causes the rod 16 to move correspondingly in translation. The rod 16 is then extended progressively from the body 10, thereby causing the shoe 28 to move away from the nut 12.

Once the stabilizer leg 3 has the desired length, the user can stop turning the nut 12 and the stabilizer leg 3 then remains in the corresponding position.

Advantageously, by looking at the marker means, the user can easily identify the extent to which the rod 16 has been extended. By way of example, the user can thus bring one, several, or all of the other stabilizer legs 3 of the game table more quickly to the appropriate lengths.

Also in an advantageous manner, the fact that the rod 16 does not turn relative to the stabilizer leg 3 while its position is being changed makes it easier to read the marker means.

The nut 12 may continue to be turned until the rod 16 reaches its extended position: in such a position the peg 20 is in abutment against the top end 22 of the slot 21 and the shoe 28 is as far as possible from the nut 12.

If the user desires to shorten the stabilizer leg 3, the user then turns the nut 12 in the opposite direction of rotation, thereby causing the rod 16 to be retracted into the inside of the stabilizer leg.

The description above relates to a stabilizer leg 3 that is simple in structure and that makes it easy for a user to shorten or lengthen said leg.

Specifically, it suffices for a user to turn the nut 12 in order to cause the rod 16 to move in translation between its two extreme positions, it being understood that the rod 16 remains in place in any of its intermediate positions between its two extreme positions.

Thus, the user has no need to lift the game table 1, or more generally no need to touch the shoe 28, in order to set each stabilizer leg 3 to its appropriate length. Furthermore, a single user can modify the length of a stabilizer leg 3 without help from another person.

Naturally, the invention is not limited to the embodiment described above, and variant embodiments may be provided without going beyond the ambit of the invention.

Thus, although above the game table is a table tennis table, the game table could be different, and for example it could be a pool table or indeed a foosball table.

Thus, although the rod moves relative to the body by moving in translation only, the rod could move relative to the body by combined movements in translation and in rotation, and in particular by moving helically. The antirotation means could thus be omitted. If antirotation means are present, they could be different from the above description: for example, it could be the rod that carries the peg and the body that carries the associated slot. Instead of a peg and a slot acting together, some other male member and female member pair could be used.

The rod could be of some other shape, and for example it could be in the shape of a cylinder without a flat.

The shoe could be secured to the rod other than by means of a ball joint. It would even be possible for the shoe to be fastened rigidly to the rod or for it to be integral with the rod.

The rod could be caused to move in translation relative to the body in a manner other than that described, for example by a crank, so that the leg need not include a nut.

The rod could be arranged outside the nut and/or outside the body.

The invention claimed is:

1. A game table comprising:

a tabletop; and at least one stabilizer leg for stabilizing said tabletop, wherein the leg comprises a body, a rod mounted to move in translation relative to the body between a retracted position and an extended position, and a shoe carried by a distal end of the rod, wherein the leg is provided with an antirotation means for preventing the rod from rotating, wherein the antirotation means comprises a male member and a female member acting together to guide a sliding of the rod in the body, wherein the male member and the female member together limit movement of the rod relative to the body, wherein the male member and the female member together form an abutment defining the extended position of the rod and/or an abutment defining the retracted position of the rod, wherein the rod is arranged at least in part inside the body, wherein the table includes a nut mounted to rotate relative to the body, the rod having an outside thread suitable for co-operating with tapping of said nut, such that turning the nut in one direction or the other causes the rod to move in translation between the extended position or the retracted position, wherein the rod remains in place in any of its intermediate positions between its two extreme positions.

2. The table according to claim 1, wherein the nut is rotatably mounted at the distal end of the body.

3. The table according to claim 1, shaped in such a manner that the shoe is substantially level with the nut when the rod is in the retracted position.

4. The table according to claim 1, wherein the rod includes marker means for identifying its position relative to the nut.

5. The table according to claim 1, wherein the male member and the female member form a peg and slot arrangement.

6. The table according to claim 1, wherein the shoe is connected to the rod by a ball joint.

7. The table according to claim 1, wherein the table is a table tennis table, a foosball table or a pool table.

8. The table according to claim 1, wherein the antirotation means is arranged to prevent the rod from rotating during the sliding of the rod between the retracted position and the extended position.

9. A game table comprising:

a tabletop; and at least one stabilizer leg for stabilizing said tabletop, wherein the leg comprises a body, a rod mounted to move in translation relative to the body between a retracted position and an extended position, and a shoe carried by a distal end of the rod, wherein the leg is provided with an antirotation means for preventing the rod from rotating, wherein the antirotation means comprises a male member and a female member acting together to guide a sliding of the rod in the body, wherein the male member and the female member together limit movement of the rod relative to the body, wherein the male member and the female member together form an abutment defining the extended position of the rod and/or an abutment defining the retracted position of the rod, wherein the male member and the female member form a peg and slot arrangement, wherein the peg is associated with the body, and the slot is associated with the rod, wherein the peg extends right through the body and is thus fastened to said body at both of its ends.

* * * * *